United States Patent [19]

Bako

[11] 3,998,077

[45] Dec. 21, 1976

[54] DRAW BOLT

[75] Inventor: Lazlo Bako, Woodcliff Lake, N.J.

[73] Assignee: Presto Lock Company, Division of Walter Kidde & Company, Inc., Elmwood Park, N.J.

[22] Filed: Oct. 10, 1975

[21] Appl. No.: 621,346

[52] U.S. Cl. ..... 70/74; 292/113

[51] Int. Cl.[2] ..... A45C 13/10

[58] Field of Search ..... 70/73, 74, 75, 76; 292/113, 114, 168; 24/191

[56] References Cited

UNITED STATES PATENTS

| | | | |
|---|---|---|---|
| 1,392,531 | 10/1921 | Shaff | 70/74 |
| 2,416,631 | 2/1947 | Komenak | 70/76 |
| 2,859,996 | 11/1958 | Atkinson | 70/73 X |
| 3,008,320 | 11/1961 | Cheney | 70/74 |
| 3,030,137 | 4/1962 | Cheney | 70/74 X |
| 3,321,230 | 5/1967 | Stollman | 292/113 |
| 3,584,906 | 6/1971 | Budzyn | 70/73 X |
| 3,698,753 | 10/1972 | Atkinson | 70/73 X |

*Primary Examiner*—James T. McCall
*Attorney, Agent, or Firm*—Shapiro and Shapiro

[57] ABSTRACT

A drawbolt for the mating shells of a container has a latch whose spaced side walls are provided with open slots that receive a transverse cross-bar on one end of a loop whose other end is engageable behind a hasp on one of the shells. Outwardly directed lugs on the side walls are received in aligned apertures in spaced guide walls of a frame, such walls having edges defining aligned peripheral cam surfaces which, together with the closed end of the slots in the latch, capture the cross-bar of the loop and establish a pivotal connection between the latch and the loop. By attaching the frame to a plate adapted to be mounted on the other of the shells, the apertures in the guide walls are closed by the plate. The free ends of a pair of upstanding tabs on the plate cooperate with the closed ends of the apertures in capturing the lugs on the latch thus establishing a pivotal connection between the latch and the frame. Pivotal movement of the latch on the frame causes the cross-bar of the loop to follow an arcuate path defined by the cam surfaces of the guide walls of the frame allowing the closed end of the loop to be drawn behind the hasp to releasably fasten together the two shells of the container.

9 Claims, 10 Drawing Figures

DRAW BOLT

The invention relates to a drawbolt for a container such as a luggage case having shells that mate and are releasably held together by the drawbolt.

BACKGROUND OF THE INVENTION

A drawbolt has a loop one end of which is pivotally connected to a latch that is itself pivotally mounted on a frame, while the closed end of the loop in engageable behind a hasp. The frame is intended for connection to one shell or section of a luggage case, and the hasp is to be secured on the other shell. The axes of the loop and of the latch are offset. By reason of the offset between the loop axis and the latch axis, pivotal movement of the latch about its axis imparts arcuate movement to the loop axis. As the latch pivots toward a terminal position at which the loop axis is positioned on one side of the latch axis and the hasp is positioned on the other, the closed end of the loop moves toward the latch axis and hence toward the hasp. When the latch reaches its terminal position, the closed end of the loop will have been drawn behind the hasp, clamping it to the frame. In such terminal position, the latch maintains the loop axis to one side of a line interconnecting the latch axis and the contact point between the hasp and the closed end of the loop, thus establishing an over-the-center toggle arrangement, and the loop will exert a drawing action on the hasp. The drawbolt is made into a lock by selectively preventing pivotal movement of the latch about its axis on the frame by means of a key-operated bolt.

Conventionally, an axis between members is achieved by forming a hole or holes in one member through which is passed a pin mounted in the other member. An axis so formed not only necessitates extra parts such as pins or rivets that must be inserted during assembly, but requires extra assembly operations when the pin or rivet must be headed-over to be secured in place. Consequently, conventional drawbolts are relatively costly to produce in terms of the number of parts and assembly operations.

The primary object of the invention is to provide a new and improved drawbolt of the type described wherein the hole/pin pivot connections are eliminated, and heading-over operations usually accompanying the use of pins and rivets become unnecessary, thereby enabling the manufacture of a product which is comparatively inexpensive to produce.

BRIEF DESCRIPTION OF THE INVENTION

Briefly, the drawbolt according to the invention, has a latch whose spaced side walls are provided with open slots into which a transverse cross-bar on the loop can freely pass defining a latch/loop-sub-assembly. Spaced guide walls of the frame are provided with apertures that open to the frame edges that are to be attached to a plate which is adapted for connection to a shell of a container. Outwardly directed lugs on the side walls of the latch can fully enter the apertures in the guide walls thus defining a latch/loop/frame sub-assembly. The guide walls of the frame have aligned peripheral cam surfaces which, together with the closed ends of the slots in the latch, capture the cross-bar of the loop and establish a pivotal connection between the loop and the latch. Finally, the edges of the frame are attached to the plate closing the apertures in the guide walls; but the plate is also provided with a pair of upstanding tabs aligned with such apertures, the free ends of the tabs, in cooperation with the closed ends of the apertures, serving to capture the lugs on the latch thus establishing a pivotal connection between the latch and the frame to complete the assembly. Pivotal movement of the latch on the frame causes the cross-bar of the loop to follow an arcuate path defined by the cam surfaces on the guide walls of the frame.

All of the components, the latch, the loop, the frame, and the plate can be stamped from sheet metal. Yet, an assembly having a latch axis and a loop axis is achieved without requiring either a pin or rivet, or a drilled or pierced hole. There is only one deformation step required, and such step is used to attach the frame to the plate to complete the assembly, and for this purpose conventional bendable tabs on the frame and matching pierced holes in the plate are employed.

The above described drawbolt is converted into a drawbolt having locking means by incorporating a key-operated springbolt in the frame before it is attached to the plate. A leg on the springbolt in its locked position, overlies an upstanding lock tab on the plate. Attempted pivotal movement of the latch in such position of the springbolt, presses the leg of the springbolt into engagement with the free end of the lock tab blocking significant pivotal movement of the latch, whereby withdrawal of the closed end of the loop from behind the hasp. The leg is provided with an opening, however, which is aligned with the lock tab when the springbolt is moved to its unlocked position in the frame. In this position, pivotal movement of the latch deflects the leg over the lock tab, allowing pivotal movement of the latch to release the loop from the hasp.

DESCRIPTION OF DRAWINGS

An embodiment of the invention is illustrated in the accompanying drawings wherein.

DETAILED DESCRIPTION OF THE INVENTION

Figure 1:
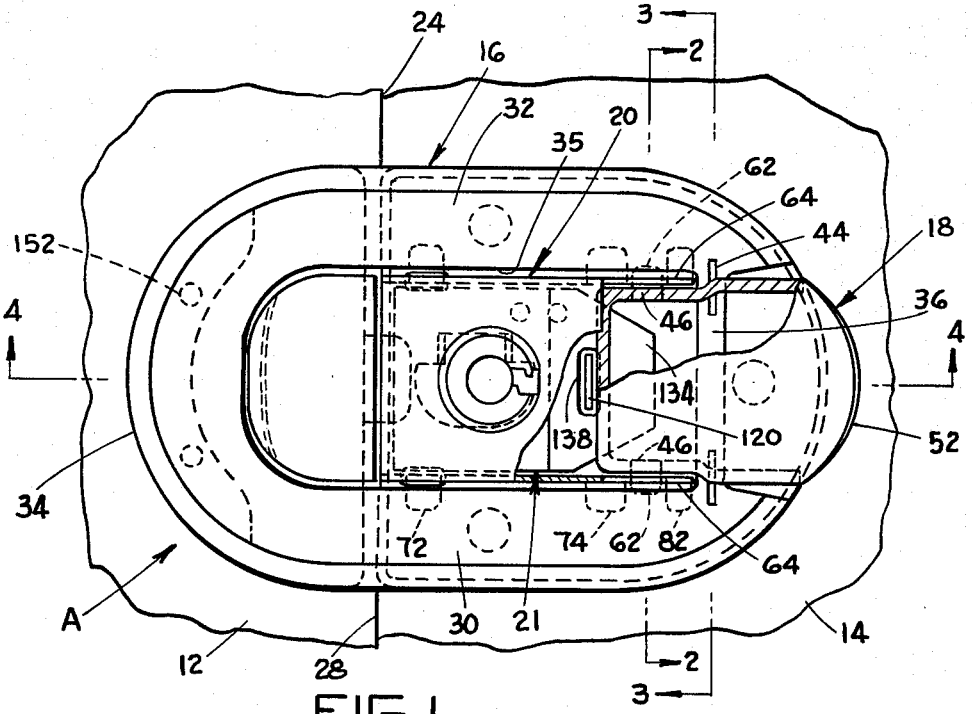
FIG. 1 is a top view of a drawbolt according to the invention, with portions broken away, showing the device in its closed or latched condition for holding together two shells of a container.

Referring to FIG. 1, 10 designates a drawbolt including locking means made according to the invention, preferably used to releasably fasten together the mating shells 12 and 14 of a container such as a luggage case, only parts of the shell walls being shown. The drawbolt comprises a loop 16, one end of which is pivotally connected to a latch 18 that is itself pivotally connected to a frame 20 mounted on a plate 22. The plate is adapted to be fixed to an edge 24 of shell 14, and hasp 26 is adapted to be fixed to an edge 28 of shell 12 for mating engagement with the drawbolt. Springbolt 21, which is selectively moveable to control pivotal movement of the latch, completes the drawbolt 10 including means for locking the device.

Figure 2:
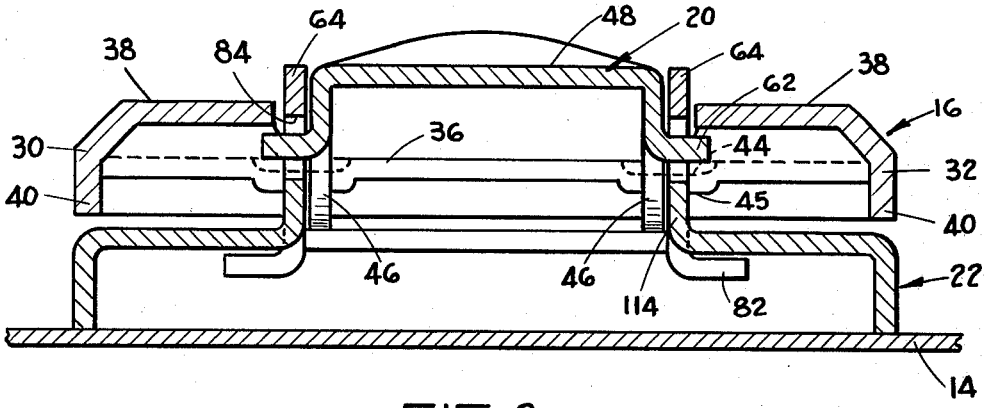
FIG. 2 is a transverse cross-sectional view of taken approximately in the plane of line 2—2 of FIG. 1.
Figure 3:
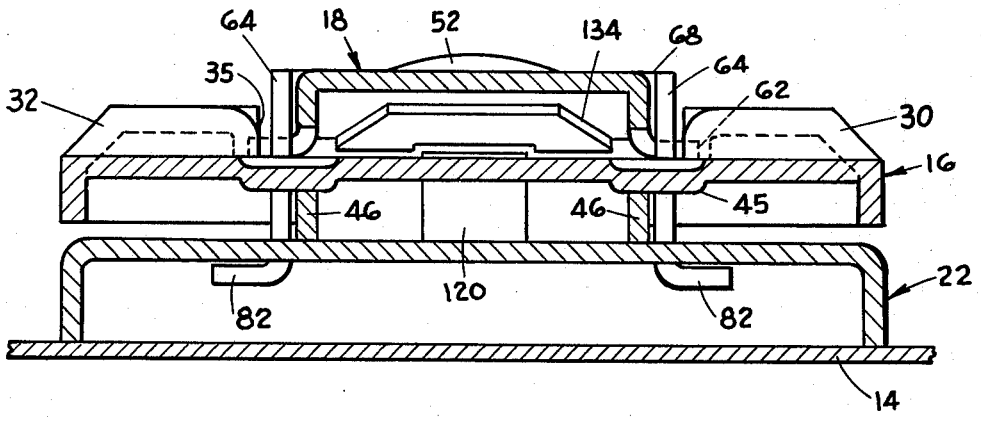
FIG. 3 is a transverse cross-sectional view taken approximately in the plane of line 3—3 of FIG. 1.
Figure 4:
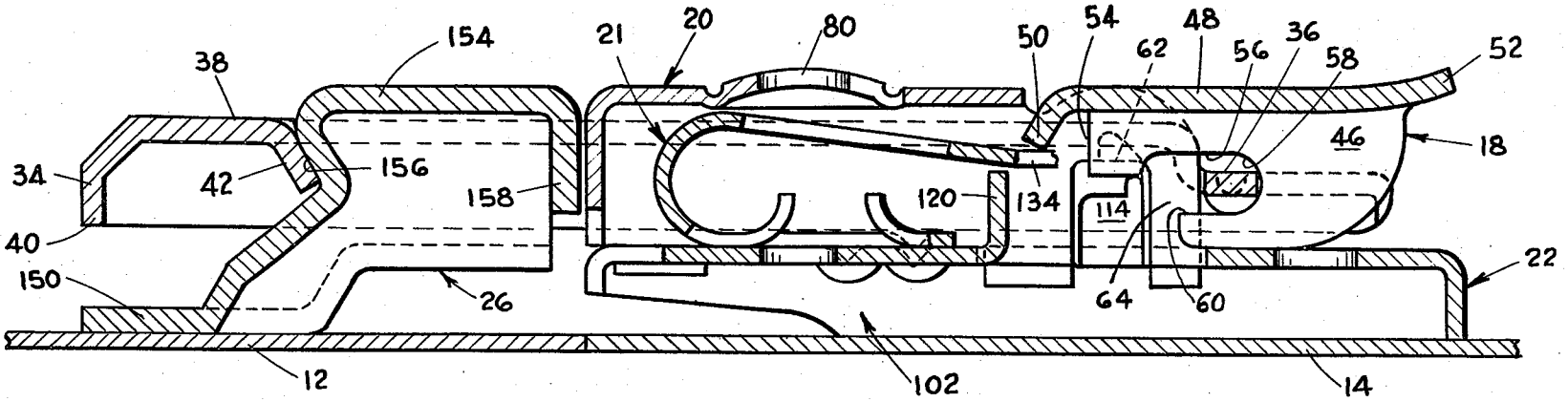
FIG. 4 is a longitudinal cross-sectional view taken approximately in the plane of line 4—4 of FIG. 1, this view the springbolt locking means in its blocking position.
Figure 5:
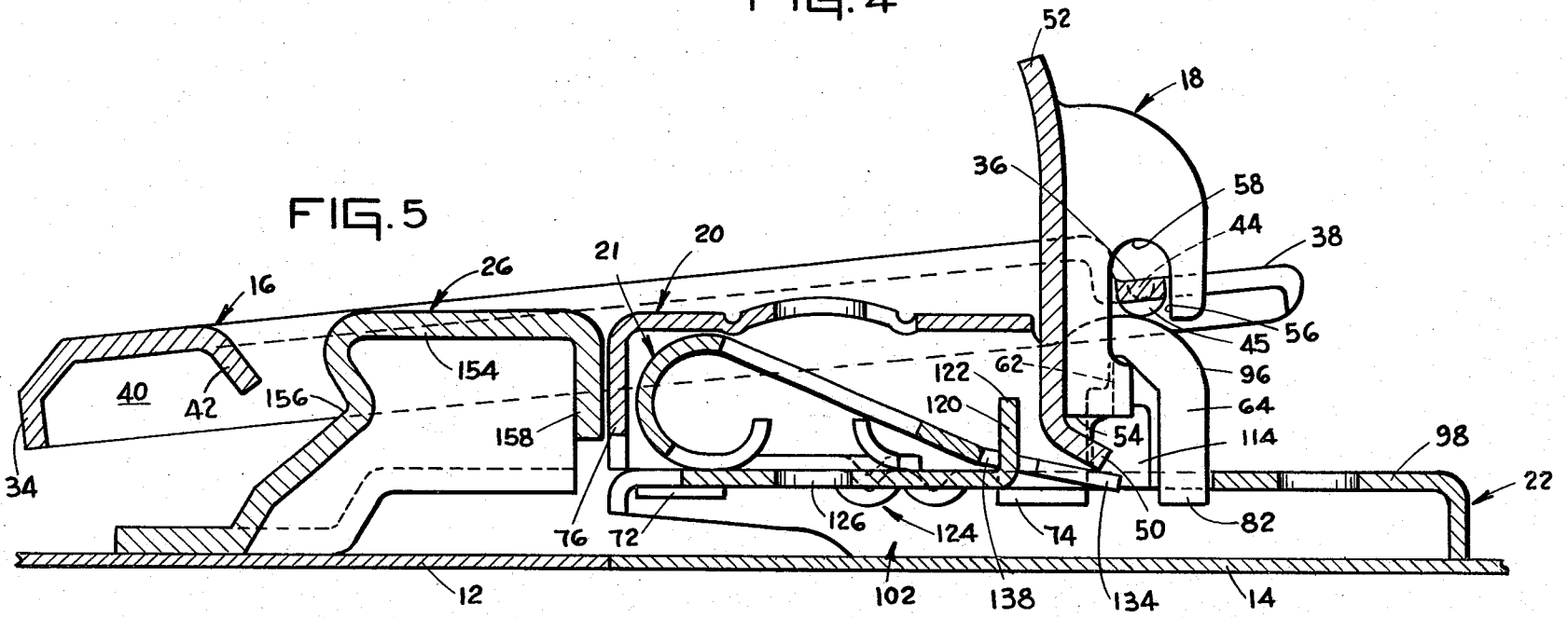
FIG. 5 is a longitudinal cross-sectional view similar to FIG. 4 but showing the relative position of the various components of the device including the locking means when it is in unlatched and unlocked condition.

As shown in FIG. 1, loop 16 has a pair of spaced, longitudinally extending legs 30 and 32 interconnected at forward end 34 to define a continuous U-shaped member having a central longitudinal opening 35, the legs being interconnected near the rearward end by transverse cross-bar 36 (FIGS. 2 and 4). Loop 16 is inverted cup-shaped in form as shown in FIGS. 2 and 3, and has flat top surface 38, an outer peripheral downturned skirt 40, and an inner peripheral downturned skirt that defines opening 35. The top surface 38 of the loop is stepped adjacent cross-bar 36 as shown best in FIGS. 4 and 5, the cross-bar being spaced from the free edge of skirt 40 a distance substantially equal to the distance from the skirt of the free edge of downturned lip 42 at forward end 34 of the loop. The lip 42 is engageable with hasp 26 as described below. Finally, the cross-bar is locally coined at 44 in the regions where it joins legs 30 and 32. Thus, while the cross-bar is essentially rectangular in cross-section, as seen in FIGS. 4 and 5, the coining operation displaces metal from the top surface 38 downwardly forming a pair of rounded ridges 45 that cooperate with the frame as described below. From the above description, it can be seen that loop 16 can be stamped from or blanked from flat strip metal stock and formed by piercing, bending, and swagging operations.

As shown in FIGS. 2 and 3, latch 18 has a pair of side walls 46 spaced from each other in a transverse direction and interconnected by top wall 48 having at its forward end a downturned lip 50 (FIGS. 4 and 5) extending between the walls. The top wall 48 is bent upwardly in its central region at the rearward end of the latch as indicated at 52 in FIGS. 4 and 5 which also show that each of walls 46 has a forward edge 54 and a longitudinally directed slot 56, the rearward end 58 of the slot being circular, and the forward end 60 of the slot being open. The slots are aligned with each other. Adjacent the forward edge 54 of each wall is an outwardly directed lug 62 that extends in the transverse direction as seen in FIG. 1 which shows that lugs 62 are aligned. From the above description, it will be apparent that latch 18 may be stamped or blanked from flat strip metal stock and formed by piercing and bending operations.

As seen in FIG. 1, side walls 46 of the latch are spaced from each other a distance less than the length of cross-bar 36 permitting the latter to be freely inserted through openings 60 into slots 56 to form a latch/loop subassembly. Moreover, walls 46 are spaced from the inner peripheral skirt defining opening 35 a distance equal to at least the thickness of metal from which frame 20 is stamped in order to provide clearance for guide walls 64 of the frame. The guide walls are spaced from each other in the transverse direction a distance less than the length of the cross-bar, but greater than the distance between the side walls 46 of the latch. In addition to the guide walls, frame 20 has side walls 66 (FIGS. 8 and 9) to which the guide walls form extensions, as shown in FIG. 9, and a top wall 68 interconnecting the side walls which terminate in a free longitudinal edge 70 having a forward tab 72 and a rearward tab 74 spaced one from the other in the longitudinal direction. The top wall and the two side walls are interconnected by a forward wall 76 so that the frame defines a space 78 for reception of the springbolt 21 as described below, which is operated by a key (not shown) passing through keyhole 80 centrally located in top wall 68.

Figure 8:
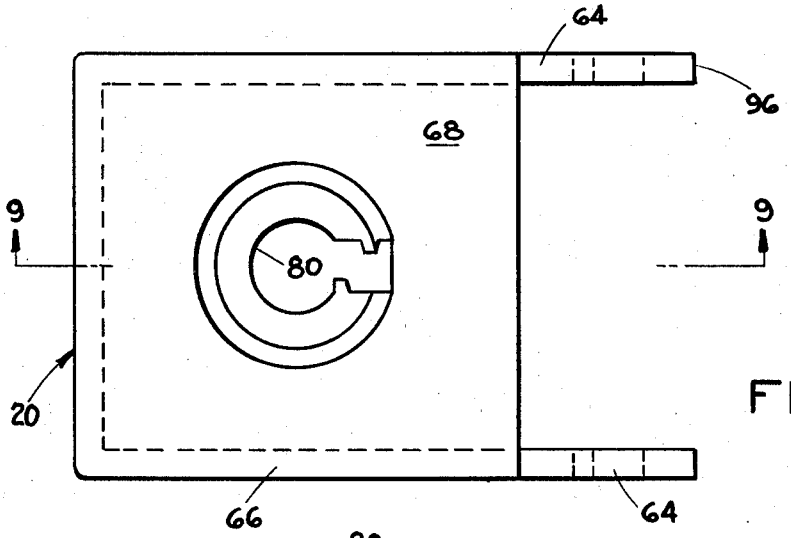
FIG. 8 is a top view of the frame component of the drawbolt.
Figure 9:
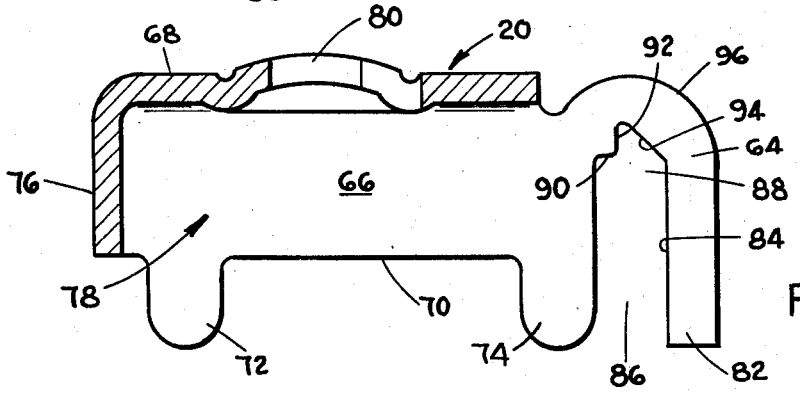
FIG. 9 is a cross-sectional view of the frame taken approximately in the plane of line 9—9 of FIG. 8.

Referring to FIGS. 8 and 9, each guide wall 64 has a longitudinal mounting edge 82 in the form of a tab, and an elongated apperture 84 having an open end 86 at edge 82 and an opposite closed end 88 having a first stop portion 90 at right angles to a second stop portion 92, and an angularly directed clearance portion 94. Finally, each guide wall has a peripheral cam edge 96 which is circular in the region of the wall remote from edge 82 and tangent to the circular portion in the region adjacent edge 82. The center of the circular portion is located centrally of aperture 84 just below the first stop portion 90 of the aperture. From the above description of the frame, it will be apparent that the frame can be stamped or blanked from flat strip metal stock and formed by piercing and bending operations.

By reason of the open ends 86 of apertures 84 in the guide walls of the frame 20, the latch/loop subassembly can be assembled onto the frame. By maintaining the latch and loop in the relationship shown in FIG. 4 (i.e., with cross-bar 36 of the loop seated in slots 56 in the side walls 46 of the latch), frame 20 can be positioned so that each guide wall 64 fits in the space between side wall 46 and the inner skirt defining opening 35 in the loop with openings 86 aligned with lugs 62. In such position, frame 20 can be moved relative to the latch/loop subassembly until stops 90 of aperture 84 engage the lugs, the edges 82 of the guide wall being received between the forward edge of cross-bar 36 of the loop and the rearward edges of lugs 62 of the latch as shown in FIG. 4. The result is a latch/loop/frame subassembly achieved without a deformation operation, and ready for attachment to plate 22.

Figure 7:
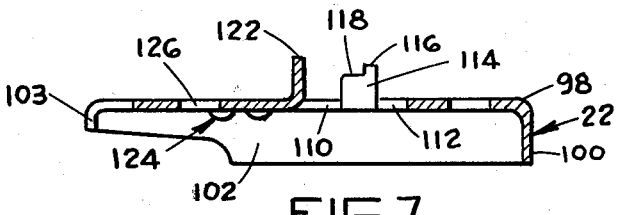
FIG. 7 is a cross-sectional view of the plate taken approximately in the plane of line 7—7 of FIG. 6.

The plate 22 has a top wall 98 and a downturned peripheral skirt 100 on the rearward portion of the plate as shown in FIG. 7. The skirt establishes a clearance space 102 between the top wall and the shell 14 when the plate is attached to the shell by fasteners or rivets passed through openings 104 in the top wall. As shown in FIG. 7, the skirt 100 does not extend as far as front edge 103 which is provided with a short downturned flange for strengthening and finishing such edge. Top wall 98 is provided near its forward end with a pair of slots 106 spaced in a transverse direction a distance equal to the spacing between tabs 72 of the frame. Rearward of slots 106, the top wall is provided with a generally rectangular cut-out 108 having a pair of transversely spaced forward notches 110 and a pair of transversely spaced rearward notches 112. The transverse spacing between the notches of each pair is the same as the transverse distance between walls 66 of the frame, while the notches 106, 110 and 112 are longitudinally spaced to match the longitudinal spacing between tabs 72, 74 and 82 of the frame.

Figure 6:
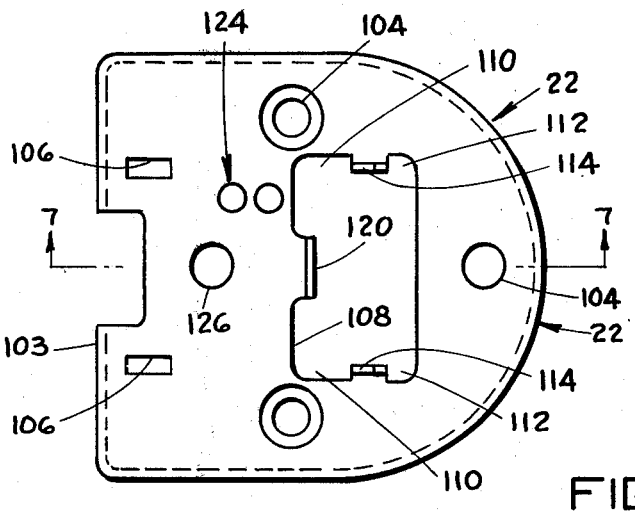
FIG. 6 is a top view of the plate of the drawbolt.

As shown in FIGS. 6 and 7, located between notches 110 and 112 on each transverse side of the cut-out are upstanding tabs 114, which are formed by a bending operation after forming the cut-out by piercing. Such tabs are spaced transversely a distance substantially equal to the transverse distance between guide walls 64 of the frame, and have a longitudinal dimension just less than the width of aperture 86 in the guide walls. Each tab 114, which cooperates with the lugs 62 on the latch as described below, has a stopped free end defining an upper stop 116 at the rearward edge of the tab and a lower stop 118 at the forward edge.

The plate 22 also has an upstanding lock tab 120 centrally located at the forward edge of cut-out 108, the tab terminating in a free end 122. As also shown in FIGS. 6 and 7, the plate has detent means 124 in the form of two transversely spaced depressions in wall 98 eccentrically located relative to the longitudinal line-of-symmetry of the plate. Both the lock tab and the detent means cooperate with springbolt 21 as described below. Finally, a key-centering opening 126 is provided in the top wall just forward of tab 120 for cooperation with the free end of a key (not shown) when the latter is used to actuate the springbolt. From the above description of the plate, it will be apparent that the plate may be stamped or blanked from flat strip metal stock and formed by piercing and bending operations.

Figure 10:
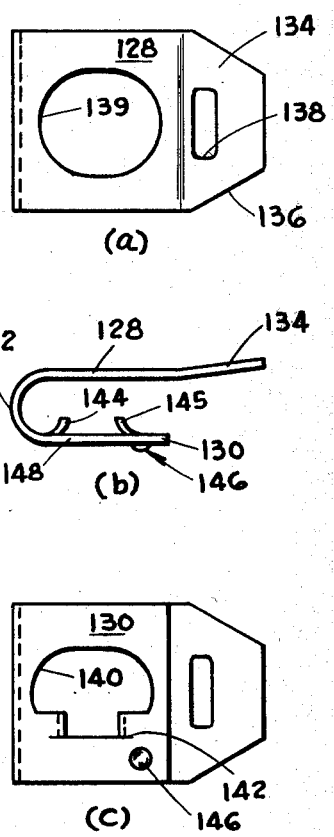
FIG. 10 shows three views of the springbolt in its unstressed condition (a) being a top view (b) being a side view and (c) being a bottom view.

The springbolt 21 of the drawbolt lock of the invention has a rectangular upper leg 128 as shown in FIG. 10 (a), a lower rectangular leg 130 parallel with the upper leg as shown in FIG. 10 (c) and a curved connecting portion 132 as shown in FIG. 10 (b). The upper leg has a terminal portion 134 that is bent upwardly at an angle of less than approximately 10 degrees and is tapered at 136. A centrally located opening 138 is provided in portion 134 of a size and configuration that will receive lock tab 120, and a central clearance hole 139 for receiving a key is also provided. The lower leg has a central clearance hole 140 that is shaped like a key-hole, the smaller longitudinal edge being defined by longitudinal slits 142 that allow the material of the springbolt to be curved out of the plane of the lower leg toward the upper leg into a pair of spaced key-engageable tangs 144 and 145 as shown in FIG. 10 (b). Finally, detent means 146 cooperable with one or the other depression of detent means 124 in plate 22 is provided in lower leg 130 in the form of a dimple on outer surface 148, the dimple projecting out of the plane of the lower leg in a direction away from upper leg 128. The springbolt may be stamped from flat spring steel or other resilient material and formed by piercing and bending operations.

As shown in FIGS. 1, 4 and 5, the hasp 26 which is cooperable with the drawbolt 10 has a flange 150 containing mounting holes 152 and a central boss 154 projecting upwardly from the flange. The shape of boss 154 conforms to the closed end of loop 16 as seen in FIG. 1; and the boss has a forward end that is undercut to form a notch 156 that is engageable by lip 42 of the loop as seen in FIGS. 4 and 5. The hasp may be stamped from a flat metal stock and formed by piercing and bending operations. In use, the hasp 26 is attached by rivets passed through holes 152 into shell 12 so that the downturned flange 158 is substantially aligned with the edge 28 of the shell.

The described sub-assembly of the latch, the loop and the frame, is combined with plate 22 after the latter has been permanently attached to a shell such as shell 14 by rivets or the like passed through openings 104 and headed over on the underside of the shell wall. The plate 22 is fixed on the wall of shell 12 near edge 28. However, before the sub-assembly is combined with the plate, springbolt 21 is placed on the plate with surface 148 of the springbolt engaged with the exposed surface of top wall 98 of the plate, and with the dimple of detent means 146 positioned in one of the depressions of detent means 124 in the plate, preferably the depression located further from lock tab 122. In this position of the springbolt, termed the unblocking terminal position, opening 138 is aligned with lock tab 122 allowing a downward force applied to leg 134 to resiliently deflect the same over tab 122 as shown in FIG. 5.

The sub-assembly of latch, loop, frame and springbolt now can be mated with the plate by aligning tabs 72, 74 and 82 on the frame with respective slots 106 and notches 110 and 112 in the plate, and bringing edges 70 of the frame into engagement with top wall 98 of the plate. As the tabs 72, 74 and 82 enter and seat within the proper slots and notches in the plate, tabs 114 on the plate enter the openings 86 in the respective guide walls 64 of the frame. Simultaneously, lip 50 of the latch engages terminal portion 134 of the springbolt tending to pivot the latch (clockwise as viewed in FIG. 4). By restraining such pivotal movement of the latch during the mating of the sub-assembly with the plate, lip 50 will depress portion 134 of leg 128 of the springbolt over the lock tab 122 almost to the position shown in FIG. 5, allowing lugs 62 to be captured between the closed end 88 of aperture 84 and the free end of tabe 114. Specifically, seating of the tabs on the frame in their respective slots and notches in the plate as edges 70 of the frame engage top wall 98 of the plate, traps each lug 62 between stop 90 on a guide wall and stop 116 on a tab 114 as shown in FIG. 4, and the latch is releasably restrained in a first terminal position. By deforming the free ends of tabs 72, 74 and 82 against the under side of the top surface 98 of the plate in the manner described below, the latch/loop/frame/springbolt assembly is permanently connected to the plate.

In order to bend that portion of the free ends of tabs 72, 74 and 82 projecting through the plate upon mating of the assembly with the plate, a tool (not shown) may be inserted into the space 102, such tool having a moveable portion that engages the projecting ends of the tabs and bends them into engagement with the under side of the top wall 98 of the plate. This is the only deformation step involved in the assembly operation; and with such deformation, assembly of the drawbolt lock of the present invention is completed.

By applying an upward force on portion 52, latch 18 can be pivoted counter-clockwise as seen in FIG. 4 from its first terminal position against the resilient bias exerted by portion 134 of springbolt on lip 50 of the latch. Rotation of the latch in such direction is limited to about 90° by the engagement of lugs 62 with stops 92 on the closed end 88 of the apertures 84 in the guide walls, edges 54 on the side walls of the latch being supported by lower stops 118 on the tabs 114. Such pivotal movement of the latch to its second terminal position causes lip 50 of the latch to deflect portion 134 of the springbolt over lock tab 120 as shown in FIG. 5. The geometry of lip 50 on the latch and its point of engagement with portion 134 on the springbolt is such as to form an over-center relationship wherein the line of force acting on the latch passes rearwardly of lugs 62 causing the springbolt to be effective in maintaining the latch in its second terminal position.

In addition to deflecting springbolt 21 and setting up an over-center relationship between the latch and the springbolt, pivotal movement of the latch from its first to its second terminal position also causes the curved portions 45 of the cross-bar on the loop to follow an arcuate path defined by the contour of cam edges 96. Lip 42 at the closed end of the loop follows a somewhat similar path in that the lip moves at least in a transverse direction away from forward wall 76 of the frame. Hence, lip 42 will be moved into a position spaced from wall 76 sufficiently to provide clearance for boss 154 of hasp 26 to be freely received within opening 35 of the loop as shown in FIG. 5.

Consequently, the edges 24, 28 of shells 12 and 14 can now be mated, i.e., the luggage case can be closed. The closed end of loop 16 does not interfere with the mating of shells 12 and 14 because the loop can be pivoted on the latch when the latter is in its second terminal position on the frame by reason of the pivotal connection resulting from the capture of cross-bar 36 within the closed ends 58 of slots 56 in the side walls of the latch and the cam edges 96 on the frame. After the edges of shells 12 and 14 are brought together, the loop can be pivoted back to the position shown in FIG. 5 in preparation for securing the shells to one another.

The shells are latched together when latch 18 is moved from its second terminal position (FIG. 5) to its first terminal position (FIG. 4). Initial movement of the latch out of its second terminal position changes the over-center situation with respect to the latch axis and the springbolt causing the latter to become effective in assisting in moving the latch toward it first terminal position. This movement is accompanied by arcuate movement of cross-bar 36 of the loop along edge 96, such arcuate movement having a transverse component that moves lip 42 on the closed end of the loop towards, and eventually into, engagement with notch 156 in the hasp. Such engagement takes place just before the latch reaches its first terminal position wherein the cross-bar and the point of engagement between lip 42 and the hasp are above the latch axis. Manual depression of the latch into its first terminal position drives the cross-bar over center and draws lip 42 into tight engagement with the hasp. Movement of the latch beyond its first terminal position is effectively precluded by the engagement of lugs 62 with stops 90 and 116, and the engagement of the longitudinal edges of side walls 46 of the latch with surface 98 of the plate.

At this point, the shells 12 and 14 are tightly clamped together and can be released by returning the latch to its second terminal position. To lock the shells together, springbolt 21 is moved longitudinally from its unblocking position (FIG. 5), wherein the dimple on the springbolt seats in the depression closer to the lock tab and opening 134 is misaligned therewith. Note that the free end of portion 134 of the springbolt has been broken away in FIG. 4 to more clearly illustrate the relationship between lug 62 on the one hand, and on the other, the closed end of aperture 84 in the guide walls of the frame, and the free end of tab 114 on the plate.

A key (not shown), is used to effect movement of the springbolt from one position to the other on the plate. Such key is inserted into key-hole 80 in top 68 of the frame, and passed through clearance holes 139 and 140 in the legs of the springbolt until the free end of the key seats in the guide hole 126 in plate 22 properly centering and supporting the key. Rotation of the key causes engagement of one or the other of tangs 144 and 145 on the springbolt and consequent movement of the springbolt.

From the above description it can be seen that the drawbolt of the extension has an axis about which the loop pivots on the latch, and an axis about which the loop pivots on the frame, each being achieved without resorting to a pin or rivet and without a deformation operation to achieve the pivotal connection. The act of permanently assembling the components together establishes the required pivotal connections.

In the event a drawbolt alone is desired (i.e., no locking capability is required), the shiftable springbolt can be dispensed with and a fixed resilient member can be used to engage lip 50 of the latch. Furthermore, the shape of the springbolt can be varied from that shown in the drawings without departing from the spirit of the present invention.

It is believed that the advantages and improved results achieved by the present invention are apparent from the foregoing description of a preferred embodiment. Various changes and modifications may be made without departing from the spirit and scope of the invention, as ought to be defined in the following claims.

I claim:

1. A drawbolt comprising:

a latch having a pair of spaced side walls;

each side wall having an edge, a longitudinally directed slot, one end of which is closed and the other end of which opens at said edge, and an outwardly extending lug, the slots in the sidewalls being aligned and the lugs being aligned;

a loop member having a cross-bar received in the slots in the latch, the length of the bar exceeding the spacing between the side walls of the latch;

frame means having a pair of guide walls spaced from each other less than the length of said cross-bar;

each guide wall having a longitudinal mounting edge, an aperture that opens at the last mentioned edge, and a curved peripheral cam edge, the apertures in the guide walls being aligned and the cam edges being aligned;

the latch being located with its side walls adjacent the respective guide walls of the frame means with the lugs received in the respective apertures of the frame means for effecting pivotal movement of the latch on the frame means; and the bar of loop member being trapped between the cam edges of the guide walls of the frame means and the closed ends of the slots in the side walls of the latch for causing the bar to be constrained to move in a curved path in response to pivotal movement of the latch.

2. A drawbolt according to claim 1 wherein said frame means includes a mounting plate and a frame having side walls interconnected by a top wall, the side walls having extensions that define said guide walls and free longitudinal edges connected to the plate so that the top wall is spaced therefrom, the plate having a pair of upstanding tabs spaced from each other and located in alignment with the apertures in the guide walls so as to be engageable by the lugs on the latch.

3. A drawbolt according to claim 2 wherein the free longitudinal edges of the side walls of the frame have bendable tabs that are insertable into matching slots in the plate for assembling the frame on the plate.

4. A drawbolt according to claim 2 wherein said loop member has a closed end spaced longitudinally from the cross-bar, and wherein said latch is pivotal in one direction on the frame from a first terminal position at which the closed end of the loop is minimally displaced from the frame to a second terminal position at which the closed end of the loop is maximally displaced from the frame; and means for limiting rotation of the latch beyond said second terminal position.

5. A drawbolt according to claim 4 wherein said means for limiting rotation comprises stop portions in the apertures in the guide walls engageable with the respective lugs on the latch.

6. A drawbolt according to claim 4 wherein the latch has a top wall interconnecting the side walls with a centrally located lip adjacent said top wall, and a spring member within the frame having a leg engaged with the lip on said latch for resiliently urging the latter toward said first terminal position on the frame.

7. A drawbolt according to claim 6 wherein said spring member is constructed and arranged so that when the latch is in its second terminal position on the frame, an over-center force is exerted on the latch for holding the same in its second terminal position.

8. A drawbolt according to claim 6 wherein said plate has an upturned lock tab thereon projecting toward the top of said frame, and said spring member has an opening in a leg portion and is selectively shiftable on the frame from a blocking position at which the opening in the leg is misaligned with the lock tab for preventing pivoting of the latch to its second terminal position, to an unblocking position at which the opening in the ledge is aligned with the lock tab to permit pivotal movement of the latch to its second terminal position, and detent means for releasably retaining the spring means in its respective blocking and unblocking positions.

9. A drawbolt according to claim 8 wherein the top wall of said frame is provided with a key-aperture to permit a key to be inserted in the space between the top wall and the plate for selectively moving the spring member on the plate from one position to the other.

* * * * *